US005429065A

United States Patent [19]

McShan

[11] Patent Number: 5,429,065

[45] Date of Patent: Jul. 4, 1995

[54] KAYAK SPRAY SKIRT QUICK-RELEASE MECHANISM

[76] Inventor: James E. McShan, 3980 El Camino Real, Space 83, Palo Alto, Calif. 94306

[21] Appl. No.: 315,939

[22] Filed: Sep. 30, 1994

[51] Int. Cl.[6] ..... B63B 35/00

[52] U.S. Cl. ..... 114/347; 114/361

[58] Field of Search ..... 114/343, 348, 347, 351, 114/361, 364, 363; 441/80, 84

[56] References Cited

U.S. PATENT DOCUMENTS

| | | | |
|---|---|---|---|
| 2,651,789 | 9/1953 | Newland | 441/84 |
| 4,520,747 | 6/1985 | Masters | 114/347 |
| 4,583,480 | 4/1986 | Hamilton et al. | 114/347 |
| 5,134,964 | 8/1992 | Masters | 114/347 |

*Primary Examiner*—Stephen P. Avila
*Attorney, Agent, or Firm*—Keith Kline

[57] ABSTRACT

A quick-release device for a kayak spray skirt. A first end of the device includes a grip loop releasably secured to the exterior of the hull of the kayak. A release strap runs over the cowling, under the spray skirt, and into the interior of the kayak. The second end of the release strap is then affixed to the underside of the hull, in the interior of the kayak. When a user pulls on the grip loop, it separates from the hull, and the release strap is pulled up. The release strap in turn pulls the spray skirt off the cowling, thereby enabling the user to exit the kayak.

2 Claims, 2 Drawing Sheets

KAYAK SPRAY SKIRT QUICK-RELEASE MECHANISM

FIELD OF THE INVENTION

The present invention relates generally to sporting goods, and more particularly is a quick-release mechanism for a kayak spray skirt.

BACKGROUND OF THE INVENTION

Kayaking is becoming an increasingly popular water sport. As is the case with many sports, there is an element of danger inherent in the activity. Specifically, the kayak may well end up in a capsized position with its user submerged beneath the surface of the water. This situation needs to be remedied fairly quickly when it occurs.

To seal the cockpit of the kayak, a device called a spray skirt is employed. The spray skirt is placed around the user's waist and around the cowling of the cockpit. The spray skirt has elasticized perimeters to ensure a snug fit, both around the user and around the cowling.

This arrangement is very effective for keeping water out of the interior of the kayak. However, it also tends to seal the user in place. If a kayaker is capsized and needs to get out of the kayak, he must extend the border of the spray skirt so that it can be slipped off the cowling before he can exit the kayak himself. This requires at least two motions—one forward motion to pull the elastic border of the spray skirt away from the cowling, and a second upward motion to remove the spray skirt from the cowling.

If the kayaker is injured or panicky, the disengaging of the spray skirt from the cowling can become a difficult process. Any difficulty in exiting the kayak could place the user in an extremely perilous situation.

OBJECTS, SUMMARY, AND ADVANTAGES OF THE INVENTION

Accordingly, it is an object of the present invention to provide a means of quickly and easily removing the spray skirt from the cowling of a kayak.

It is a further object of the present invention to provide a mechanism for quick-release of the spray skirt that can be used as either original equipment or added to already manufactured kayaks.

In summary, the present invention is a quick-release device for a kayak spray skirt. A first end of the device includes a grip loop releasably secured to the exterior of the hull of the kayak. A release strap runs over the cowling, under the spray skirt, and into the interior of the kayak. The second end of the release strap is then affixed to the underside of the hull, in the interior of the kayak. When a user pulls on the grip loop, it separates from the hull, and the release strap is pulled up. The release strap in turn pulls the spray skirt off the cowling, thereby enabling the user to exit the kayak.

An advantage of the present invention is that it provides a mechanism that requires only a single motion to remove the spray skirt form the cowling of a kayak.

Another advantage of the device is that it is simple and inexpensive.

Still another advantage of the present invention is that it can be installed by a kayak manufacturer as original equipment, or it can easily be added to existing kayaks.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
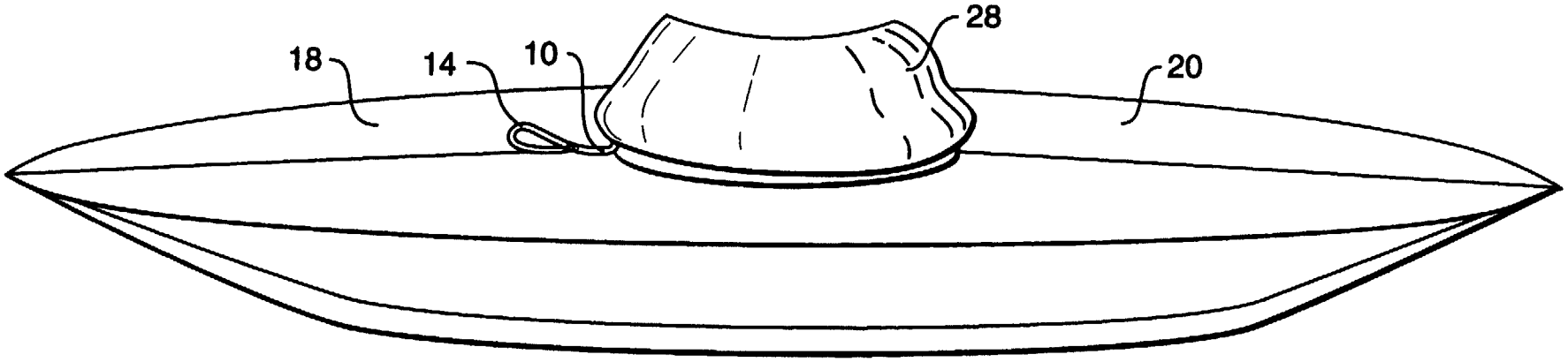
FIG. 1 is a perspective view of the quick-release mechanism installed on a kayak.
Figure 2:
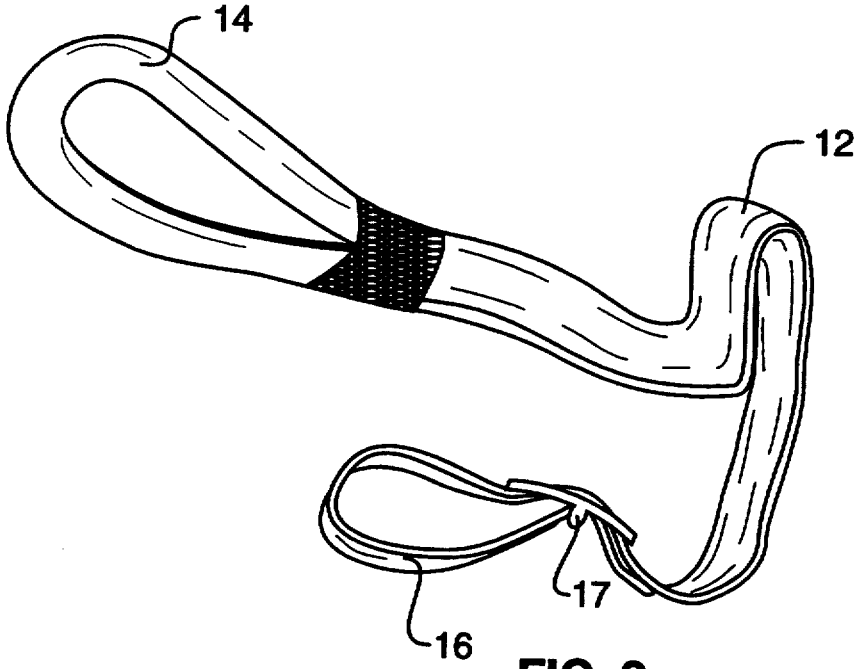
FIG. 2 is a detail perspective view of the quick-release-mechanism.
Figure 3:
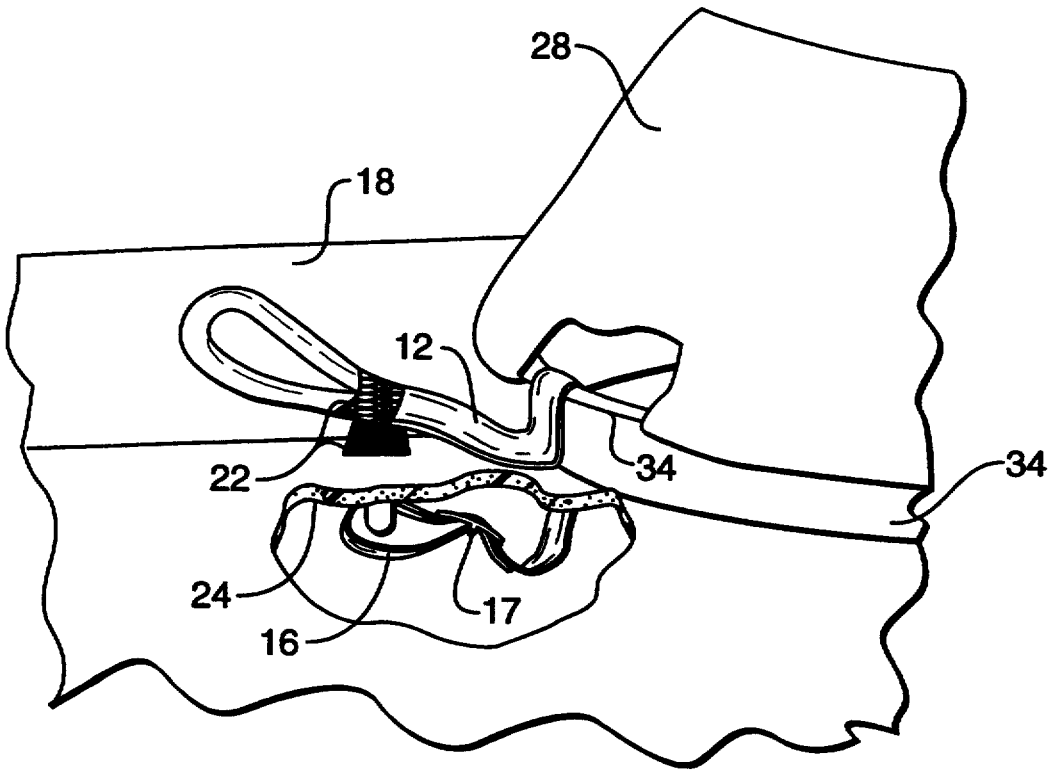
FIG. 3 is a partially broken detail view of the mechanism as installed on a kayak.

The present invention is a kayak spray skirt quick-release mechanism 10. The quick-release mechanism 10 comprises chiefly a release strap 12, which includes a grip 14 at a first end and an adjustable affixing means 16 at a second end. The strap 12 will usually be formed from tube strapping to facilitate conformation of the grip 14.

In the preferred embodiment, the grip 14 and the affixing means 16 are simply formed by making loops in the ends of the actuating strap 12. While the grip loop 14 is sewn for a permanent loop, the affixing means 16 is formed with a buckle 17 so that the loop size, as well as the effective length of the strap 12, are adjustable. In addition, a stay may be inserted in the grip 14 in order to help it hold its circular shape.

The grip 14 is removably attached to the exterior of a hull 18 of a kayak 20. A releasable attachment means 22 holds the grip 14 in place on the exterior surface of the hull 18. The releasable attachment means can be a simple hook-and-eye type fastener, such as Velcro, with one element of the fastener affixed to the grip 14, and the other element of the fastener affixed to the hull 18.

The affixing means 16 in the second end of the strap 14 is secured in the interior surface of the hull 24 by an anchoring element 26. The anchoring element 26 can be a D-ring secured to the interior of the hull 24.

A spray skirt 28 seals the cockpit opening of the kayak 20. The spray skirt 28 includes an inner elasticized perimeter 30 which fits around the kayaker's waist, and an outer elasticized perimeter 32 which fits around a cowling 34 integral to the cockpit.

When installed, the first end of the release strap 12 is releasably secured to the attachment means 22. The strap 12 runs along the exterior of the hull 18 and around the cowling 34. The strap 12 passes under the spray skirt 28 as it passes around the cowling 34. The strap then passes into the interior of the hull 24, where the second end of the strap 12 is affixed to the anchoring element 26.

Thus, when the kayaker wants to exit the kayak, he pulls on the grip 14 which removes the grip 14 from the attachment means 22. The strap 12 then pulls the outer elasticized perimeter 32 of the spray skirt 28 away from the cowling 34. With the spray skirt 28 removed form the cowling 34, the kayaker is free to exit the kayak 20.

Since the affixing means 16 remains secured to the interior of the hull, the kayaker can retain control of the kayak by keeping a grip on the strap 12.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A kayak spray skirt quick-release mechanism comprising:

a release strap with a grip at a first end and an affixing means at a second end; wherein said first end of the release strap is releasably secured by a releasable attachment means to an exterior of a hull of a kayak at a position in front of a cockpit of the kayak so that it is easily accessible to a user, said release strap is positioned so that it runs under an outer perimeter of a spray skirt secured to a cowling of the cockpit, and said second end of the release strap is affixed to an interior of the hull of the kayak; such that when the user pulls on said grip at said first end of the release strap, the grip is removed from said releasable attachment means, the release strap in turn pulling said spray skirt away from said cowling, thereby allowing the user to exit the kayak, the second end of the strap remaining secured to the kayak so that by retaining his grip on the strap, the user retains contact with the kayak.

2. The mechanism of claim 1 wherein:

a stay is inserted into the grip at the first end of said release strap so that the grip retains a desired shape.

* * * * *